United States Patent [19]

Sando et al.

[11] Patent Number: 4,480,448

[45] Date of Patent: Nov. 6, 1984

[54] APPARATUS FOR WET-HEAT TREATING A CLOTH

[75] Inventors: Yoshikazu Sando; Hiroshi Ishidoshiro, both of Wakayama, Japan

[73] Assignee: Sando Iron Works Co., Ltd., Japan

[21] Appl. No.: 473,041

[22] Filed: Mar. 7, 1983

[30] Foreign Application Priority Data

Mar. 17, 1982 [JP] Japan ..... 57-42076

[51] Int. Cl.[3] ..... D06B 3/12; D06B 23/18

[52] U.S. Cl. ..... 68/5 E; 68/9; 68/207

[58] Field of Search ..... 68/5 E, 9, 207

[56] References Cited

U.S. PATENT DOCUMENTS 4,357,811 11/1982 Sando et al. ..... 68/5 E

FOREIGN PATENT DOCUMENTS 2069554 8/1981 United Kingdom ..... 68/5 E 2079800 1/1982 United Kingdom ..... 68/5 E

*Primary Examiner*—Philip R. Coe

*Attorney, Agent, or Firm*—McGlew and Tuttle

[57] ABSTRACT

An apparatus for wet-heat treating a cloth in a high pressure steamer provided with an inlet side seal mechanism having a liquid seal tank and an outlet side seal mechanism having a slow cooling tank, comprising a plurality of liquid apply tanks provided along a cloth passage for transporting a cloth continuously in the steamer body, in such a manner that either a treating solution or hot water is applied to the cloth selectively and repeatedly from the liquid seal tank or the slow cooling tank with the aid of liquid apply pipes having a valve respectively. Treatment of a long cloth such as pretreatment including desizing, bleaching and scouring as well as dyeing can be done speedily, effectively and eminently.

8 Claims, 1 Drawing Figure

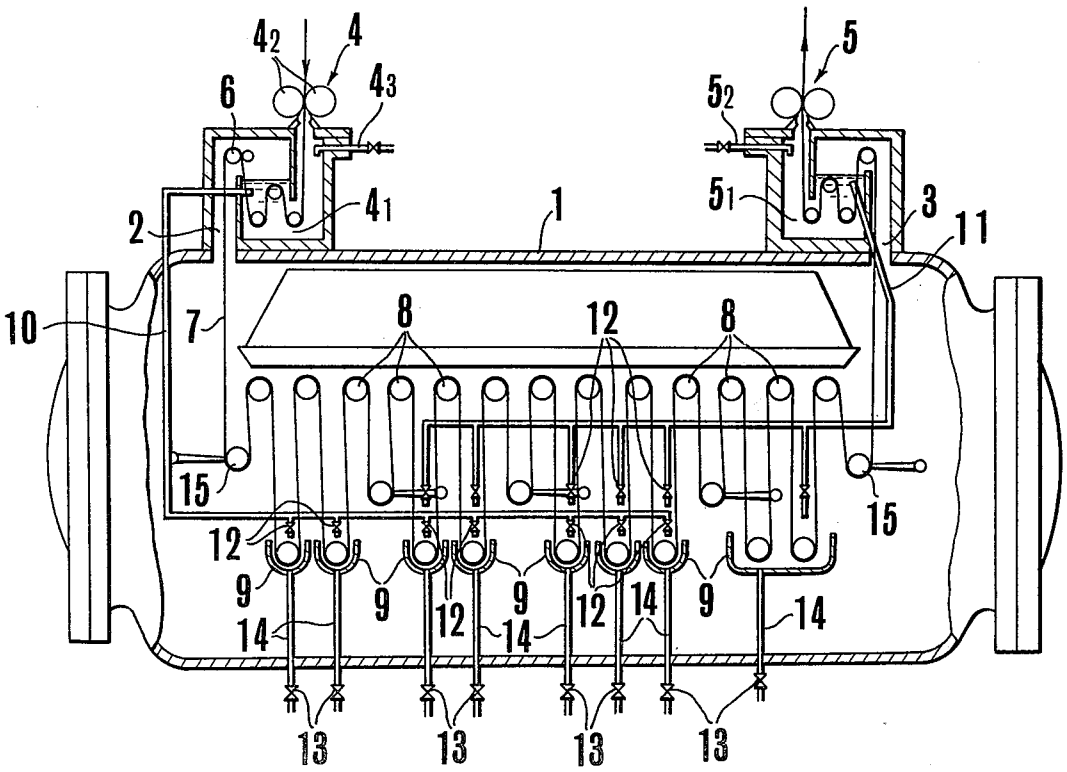
1
2
3
4
$4_1$
$4_2$
$4_3$
5
$5_1$
$5_2$
6
7
8
9
10
11
12
13
14
15

APPARATUS FOR WET-HEAT TREATING A CLOTH

BACKGROUND OF THE INVENTION

The present invention relates to an apparatus for wet-heat treating a long cloth continuously.

In subjecting a long cloth to such treatments as pretreatment including desizing, bleaching and scouring as well as dyeing continuously, either a Parble Range (trade name) developed by the present applicants or a high pressure steamer has conventionally been applied. Wet heat treatment by using a high pressure steamer is effective for the said treatments of a cloth, and the treatment can be done speedily. However, a conventional high pressure steamer for wet-heat treating a cloth is usually used in such manner as to apply treating solution (a caustic alkali solution for pretreatment, weight reduction etc. and a dye solution for dyeing) in a liquid tank provided outside of the steamer body or in a liquid seal tank provided in the inlet side seal mechanism of the high pressure steamer, and then the cloth soaked with a treating solution in this way is introduced in the steamer body for the wet-heat treatment. The application of a treating solution to the cloth is done only one time prior to the wet-heat treatment, so that the amount of treating solution applied to the cloth is frequently insufficient according to the kind of cloth and an effective treatment of the cloth cannot be done satisfactorily.

For instance, in transporting a cloth printed with a dye of a prescribed pattern continuously through a conventional high pressure steamer under high temperature and high pressure wet heat for fixing the dye to the cloth, it is unavoidable that the interior of the steamer body reaches a state of dry heat and cannot be maintained in a state of wet heat, and it frequently needs a relatively long time (for instance, 2 to 3 minutes) owing to the deficiency of humidity until the dye is fixed completely to the cloth. Thus, it is impossible that an excellent dyeing can be done speedily.

It has been considered to soak a printed cloth with a large amount intentionally before the cloth is supplied in the high pressure steamer for the purpose of supplementing the deficiency of wet heat in the steamer body. In this instance, however, there are such difficulties that a part of the printed dye is transferred on the surface of the seal roll for staining the seal roll and the cloth is squeezed too much due to the nipping pressure in passing the cloth through a pair of seal rolls at the inlet of the steamer body.

Under such circumstances, the present applicants have proposed a new process and apparatus for wet-heat treating a cloth continuously. The outline of the process is such that, in a high pressure steamer having seal mechanisms provided with a liquid seal tank for wet-heat treating a long cloth continuously, a cloth to be treated is passed through the said liquid seal tank, which is filled stationarily with a definite amount of a treating solution, such as a treating solution or a dye solution, and then the cloth is transported continuously through the steamer body while immersing the cloth in the treating solution, which is introduced in a plurality of liquid apply tanks provided in the steamer body from the liquid seal tank, for subjecting the cloth alternately to steaming and boiling. The present invention relates to an improvement of the said apparatus.

SUMMARY OF THE INVENTION

Accordingly, the object of the present invention is to offer an apparatus for subjecting a long cloth to such treatments as pretreatment, dyeing and weight reduction continuously by using a high pressure steamer, in which the numbers of steaming and boiling treatments repeated in the steamer body are controlled in accordance with the kind and thickness of the cloth to be treated a well as with the kind of treating solution to be employed.

The essential points of the present inventive apparatus comprise, in a high pressure steamer provided with a cloth inlet and a cloth outlet for taking in and out a cloth to be treated continuously through the steamer body, the said cloth inlet being provided with an inlet side seal mechanism having a liquid seal tank and the said cloth outlet being provided with an outlet side seal mechanism having a slow cooling tank, providing a plurality of liquid apply tanks along a cloth passage, which is to transport the cloth continuously in the steamer body, so as to apply either a treating solution or hot water to the cloth selectively from the liquid seal tank or from the slow cooling tank with the aid of corresponding liquid apply pipes having respectively a valve.

BRIEF DESCRIPTION OF THE DRAWING

The drawing is a sectional one showing an example of the present inventive apparatus for wet-heat treating a cloth continuously.

DETAILED DESCRIPTION OF THE PREFERRED EMBODIMENTS

Preferred embodiments of the present invention will be described in detail in the following with reference to the drawing showing an example of the inventive apparatus.

In the drawing, 1 is a high pressure steamer body for wet-heat treating a cloth, and the steamer body 1 is provided with a cloth inlet 2 and a cloth outlet 3 respectively having an inlet side seal mechanism 4 and an outlet side seal mechanism 5 for maintaining the interior of the steamer body with a high temperature and high pressure wet heat, for instance, in the temperature range between 100° C. and 160° C.

The inlet side seal mechanism 4 comprises a nearly J-shaped liquid seal tank $4_1$ and a pair of seal rubber rolls $4_2$ which is to seal the upper opening of the liquid seal tank $4_1$. A treating solution supply pipe $4_3$ is also provided above the liquid seal tank $4_1$. 6 is a pair of squeeze rolls provided near the outlet of the liquid seal tank $4_1$ for removing excess treating solution adhering to the cloth coming out of the liquid seal tank.

The outlet side seal mechanism 5 comprises a slow cooling tank $5_1$, and a cooling water supply pipe $5_2$ is attached thereto. Water at the normal temperature or cooled water is supplied into the slow cooling tank $5_1$, and its temperature and amount are controlled so that the temperature of the cooling water is about 50° C. at the outlet of the tank.

In the interior of the steamer body 1, a plurality of cloth guide rolls 8 are provided up and down alternately for transporting a cloth to be treated 7 up and down in a zigzag path forming snaky undulations through the steamer body. At the bottom part of the steamer body 1, a plurality of liquid apply tanks 9 are provided at proper intervals for immersing the cloth repeatedly in the treating solution or hot water, while the cloth is transported through the steamer body. These liquid apply tanks 9 are fitted respectively with a piping 10 for supplying the treating solution from the liquid seal tank $4_1$ in the liquid apply tank and another piping 11 for supplying hot water from the slow cooling tank $5_1$ in the liquid apply tank, and a valve 12 is provided to each of the pipings 10 and 11 for operating the pipings 10 and 11 corresponding to each of the liquid apply tanks 9. Each of the liquid apply tanks 9 is fitted also with a liquid discharge pipe 14 having a valve 13. These switch valves 12 and 13 are provided outside of the steamer body 1, and can be opened and shut selectively by the automatic or hand operation. 15 are tension control rolls substituting the cloth guide rolls 8.

The construction of an example of the present inventive apparatus for wet-heat treating a cloth is as above-described. An example of the wet-heat treatment of a cloth by using the above-mentioned apparatus will now be described in the following.

At first, the interior of the steamer body 1 is filled with water vapor so as to maintain the interior of the steamer body with a wet heat at a temperature in the range, for instance, from 140° C. to 160° C., the liquid seal tank $4_1$ in the inlet side seal mechanism 4 is filled with a treating solution (for instance, a caustic alkali solution or hydrogen peroxide solution in the case of pretreatment and weight reduction, and a dye solution in the case of dyeing) by means of the liquid supply pipe $4_3$, and the slow cooling tank $5_1$ is filled with water at a temperature about 50° C. by supplying cooling water from the liquid supply pipe $5_2$.

Then, a cloth to be treated 7 is supplied through the inlet side seal mechanism 4 into the interior of the steamer body 1. The cloth is soaked with the treating solution in the liquid seal tank $4_1$, squeezed suitably by means of the squeeze rolls 6, guided with the use of the first tension control roll 15, and transported through the steamer body 1 by means of the cloth guide rolls 8 while receiving wet-heat treatment, i.e., steaming. In the meanwhile, a number of the liquid apply tanks 9 are filled with the treating solution from the liquid seal tank $4_1$ by opening the corresponding valves 12 for soaking the cloth with the treating solution intermittently and repeatedly in the course of the wet-heat treatment. Toward the end of the process, some of the remaining liquid apply tanks 9 are filled with hot water coming from the slow cooling tank $5_1$ for applying hot water to the cloth, i.e., for boiling the cloth. Thereby, the cloth is also washed preliminarily. The number of the liquid apply tanks to be filled with the treating solution and with hot water may be altered selectively according to the nature of the cloth to be treated. During the said process, the amounts of the treating solution in the liquid seal tank $4_1$ and cooling water in the slow cooling tank $5_1$ are kept constant.

In this way, the cloth 7 receives boiling and steaming alternately and repeatedly, so that such treatments as the pretreatment and dyeing of a cloth can effectively be done by using the present inventive apparatus. Particularly, in the present inventive apparatus, the application of the treating solution and hot water to the cloth can selectively be changed with a controlled frequency by operating the valves 12 in the course of wet-heat treating the cloth in the steamer body, and these conditions can freely be changed in accordance with the nature, i.e., the kind, thickness, etc. of the cloth to be treated. In this way, the present inventive apparatus is excellent and universal for the wet-heat treatment of a long cloth continuously.

What is claimed is:

1. Apparatus for wet-heat treating a cloth in a high pressure steamer, which comprises a steamer body having a cloth inlet and a cloth outlet for correspondingly continuously inserting and removing a cloth to be treated in the steamer body, the cloth inlet being provided with an inlet side seal mechanism having a liquid seal tank for holding a treating solution and the cloth outlet being provided with an outlet side seal mechanism having a slow cooling tank for holding water, transport means for transporting the cloth continuously along a cloth passage in the steamer body from the cloth inlet to the cloth outlet and correspondingly in turn through the liquid seal tank and the slow cooling tank, a plurality of liquid apply tanks provided in the steamer body and arranged selectively along the cloth passage, a treating solution apply pipe having treating solution supply valve means and extending from the liquid seal tank to the liquid apply tanks and arranged in the steamer body for selectively applying treating solution to the cloth in the liquid apply tanks, a hot water apply pipe having hot water supply valve means and extending from the slow cooling tank to the liquid apply tanks and arranged in the steamer body for selectively applying hot water to the cloth in the liquid apply tanks, said supply valve means being arranged for corresponding independent selective operation whereby either treating solution or hot water may be correspondingly applied selectively and repeatedly to the cloth in the respective liquid apply tanks from the liquid seal tank or the slow cooling tank upon selective operation of the corresponding supply valve means.

2. Apparatus of claim 1 wherein the supply valve means are arranged outside of the steamer body for individual selective and repeated operation.

3. Apparatus of claim 1 wherein each of the liquid apply tanks is provided with a discharge pipe having a discharge valve for selectively discharging the corresponding liquid therefrom.

4. Apparatus of claim 3 wherein the discharge valves are arranged outside of the steamer body for individual selective and repeated operation.

5. Apparatus of claim 1 wherein the liquid apply tanks included at least one initial treating solution apply tank, at least one intermediate liquid apply tank and at least one final hot water apply tank, the treating solution apply pipe includes a first treating solution branch pipe portion arranged for selectively applying treating solution to the cloth in the at least one initial apply tank and a second treating solution branch pipe portion arranged for selectively applying treating solution to the cloth in the at least one intermediate apply pipe, the hot water apply pipe correspondingly includes a first hot water branch pipe portion arranged for selectively applying hot water to the cloth in the at least one final apply tank and a second hot water branch pipe portion arranged for selectively applying hot water to the cloth in the at least one intermediate apply tank, and the supply valve means correspondingly include first treating solution branch valve means arranged for independent selective operation for controlling the supply of treating solution from the first treating solution branch pipe portion to the cloth in the at least one initial apply tank, second treating solution branch valve means arranged for independent selective operation for controlling the supply of treating solution from the second treating solution branch pipe portion to the cloth in the at least one intermediate apply tank, first hot water branch valve means arranged for independent selective operation for controlling the supply of hot water from the first hot water branch pipe portion to the cloth in the at least one final apply tank, and second hot water branch valve means arranged for independent selective operation for controlling the supply of hot water from the second hot water branch pipe portion to the cloth in the at least one intermediate apply tank.

6. Apparatus of claim 5 wherein the supply valve means are arranged outside of the steamer body for individual selective and repeated operation.

7. Apparatus of claim 5 wherein each of the corresponding liquid apply tanks is provided with a discharge pipe having a discharge valve for selectively discharging the corresponding liquid therefrom.

8. Apparatus of claim 7 wherein the discharge valves are arranged outside of the steamer body for individual selective and repeated operation.

* * * * *